US005563610A

United States Patent [19]

Reudink

[11] Patent Number: 5,563,610

[45] Date of Patent: Oct. 8, 1996

[54] NARROW BEAM ANTENNA SYSTEMS WITH ANGULAR DIVERSITY

[75] Inventor: Douglas O. Reudink, Bellevue, Wash.

[73] Assignee: Metawave Communications Corporation, Redmond, Wash.

[21] Appl. No.: 488,793

[22] Filed: Jun. 8, 1995

[51] Int. Cl.[6] ..... H01Q 3/22

[52] U.S. Cl. ..... 342/375; 455/277.1

[58] Field of Search ..... 342/375; 455/276.1, 455/277.1, 277.2

[56] References Cited

U.S. PATENT DOCUMENTS

| | | | |
|---|---|---|---|
| 4,797,950 | 1/1989 | Rilling | 455/276 |
| 4,998,261 | 3/1991 | van Driest et al. | 375/1 |
| 5,233,626 | 8/1993 | Ames | 375/1 |
| 5,289,499 | 2/1994 | Weerackody | 375/1 |
| 5,434,893 | 7/1995 | Ley Roy et al. | 375/208 |
| 5,459,873 | 10/1995 | Moore et al. | 455/277.1 |
| 5,504,936 | 4/1996 | Lee | 455/33.2 |

*Primary Examiner*—Theodore M. Blum
*Attorney, Agent, or Firm*—Fulbright & Jaworski L.L.P.

[57] ABSTRACT

A receiving system 100 is disclosed which includes at least one antenna 101 providing a plurality of antenna beams. A first processing branch 103 is included for processing a first plurality of signals appearing within a first plurality of the antenna beams. The first processing branch 103 includes a plurality of delay paths 105 each receiving a one of the first plurality of signals from a corresponding one of the first plurality of antenna beams and applying a predetermined amount of delay thereto, the preselected amount of delay proportionate to the corresponding one of the beams. First processing branch 103 further includes a combiner 106 for combining the first plurality of signals after output from the plurality of delay paths 105. A second processing branch 104 is provided for processing a second plurality of signals appearing within a second plurality of the antenna beams. Second processing branch 104 includes a plurality of delay paths 105, each delay path receiving one of the second plurality of signals from a corresponding one of the second plurality of antenna beams and applying a pre-selected amount of delay thereto, the pre-selected amount of delay being proportionate to the corresponding one of the beams. Second processing branch 104 further includes a combiner 106 for combining the second plurality of signals after output from the plurality of delay paths 105. Finally, a receiver 102 is provided having a first port coupled to an output of first processing branch 103 and a second port coupled to a second processing branch 104.

34 Claims, 4 Drawing Sheets

FIG. 5
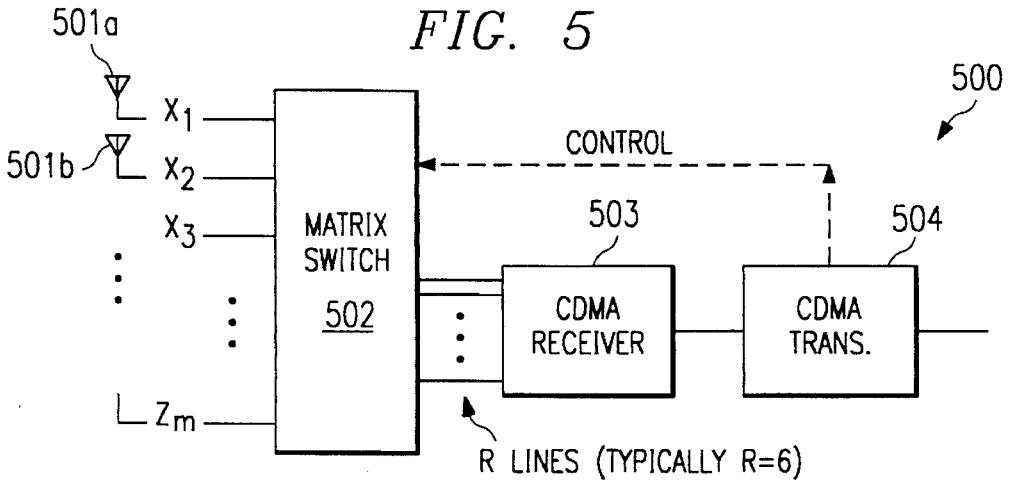
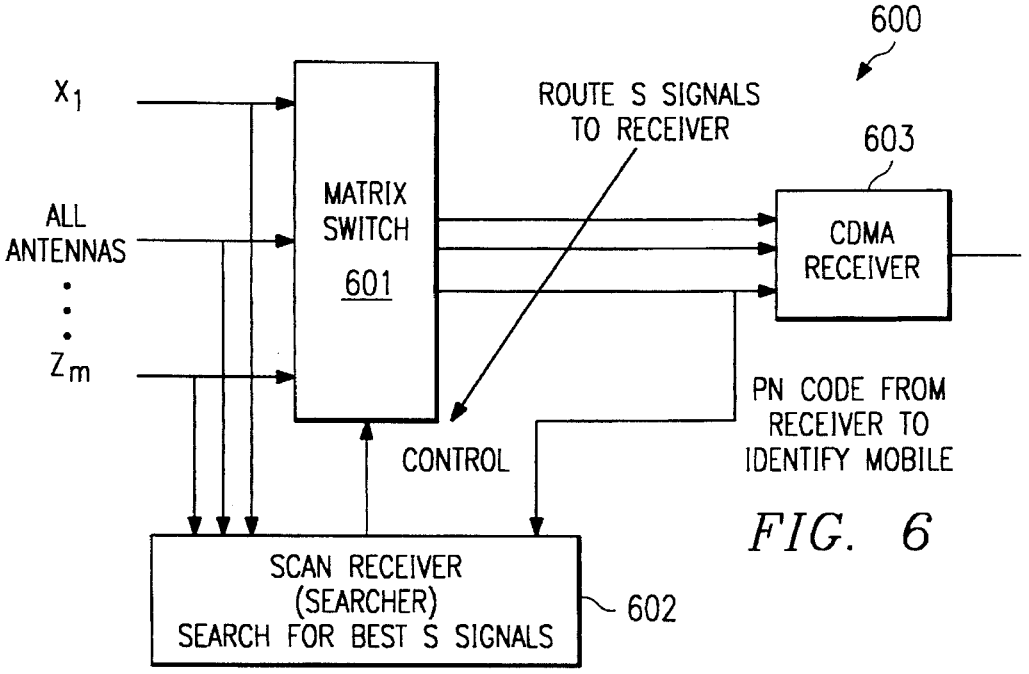
FIG. 6
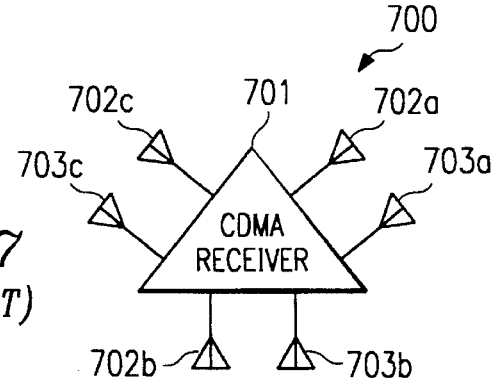
FIG. 7
(PRIOR ART)

NARROW BEAM ANTENNA SYSTEMS WITH ANGULAR DIVERSITY

TECHNICAL FIELD OF THE INVENTION

The present invention relates in general to wireless communications systems and in particular to apparatus, systems and methods for combining antennas in such systems.

BACKGROUND OF THE INVENTION

Code division multiple access (CDMA) signalling is particularly useful in wireless communications systems, such as cellular telephone systems. Among its advantages, CDMA allows multiple users to simultaneously access a single channel. In a typical CDMA system, a pseudo-noise spreading code (in a direct sequence system a sequence of "chips") is used to biphase modulate an RF carrier. The resulting phase-coded carrier is in turn biphase modulated by a data stream. A second orthogonal code overlays the spreading code which allows a base station to individually identify and communicate with multiple mobile units. The resulting coded CDMA signal is then amplified and transmitted. At the receiver, the CDMA signal is despread and the data extracted by demodulation.

The performance of all wireless communications systems, including CDMA systems, is adversely affected by interference. One source of interference at the base station is caused by the simultaneous receipt of signals from multiple remote (mobile) units, and in particular when those mobile units are broadcasting on the same frequency. Assuming an ideal antenna and signal propagation conditions, and that the base station is receiving signals of substantially the same power from each of the mobile units, the level of interference noise is directly proportional to the number of mobile unit signals received at the base station antenna. The multiple received signals can raise the noise floor or destructively combine to cause fading. This problem is compounded when a mobile unit closer to the base station masks the signals received from mobile units further distant.

Another type of interference which adversely affects wireless communications systems is caused by multipath effects. In this case, the signal broadcast from a given mobile unit will reflect off various objects in the surrounding environment. As a result, multiple reflected signals taking multiple paths of varying path lengths arrive at the receiver. These multipath components (reflections) arrive at the receiver antenna with varying time delays (phase differences), and depending on the corresponding path lengths, may combine to produce fades in signal strength. In the worst case where multipath signals are received one-half wavelength out of phase, a null can occur do to signal cancellation.

By minimizing interference, the strength of a given mobile unit signal received at the base station antenna can be maximized. Consequently, the mobile unit to base station separation and/or the ability to extract data from that signal is improved (i.e. an improved bit-error rate is achieved). A similar result can be achieved if the gain of the receiver and/or its antenna is increased. The most substantial improvements in receiver performance occur if interference minimization is achieved in conjunction with an increase in gain.

The Rake receiver is a standard receiver often used in CDMA base wireless communications systems because of its capability of reducing multipath fading. In one configuration, the Rake receiver receives data from three 120 degree sectors, together providing 360 degree coverage. Each 120 degree sector is covered by two 120 degree antennas with identical views, one antenna feeding the receiver sector port and the other feeding the receiver diversity port. Alternatively, omni-directional antennas may be used to feed a CDMA receiver having only a sector and a diversity port. According to the IS-95 standard, each CDMA receiver is constructed from four Rake receivers, each for resolving one "finger" (i.e. time delayed multipath components from a given mobile unit). In this case, the four strongest signals received from any sector or the diversity antennas are processed by the corresponding four fingers of the receiver and combined to improve data recovery.

It should be noted that in current CDMA receiving systems, the antennas are typically separated by a predetermined number of wavelengths in order to provide spacial diversity. This spacial diversity insures that the incoming multipath components from a given mobile unit transmission are substantially uncorrelated. Two such prior art systems are disclosed in U.S. Pat. No. 5,347,535 to Karasawa et al., entitled "CDMA Communications System," and U.S. Pat. No. 5,280,472 to Gilhousen et al., entitled "CDMA Microcellular Telephone System And Distributed Antenna System Therefor."

If the number of required antennas could be reduced, and/or the need to space antennas by substantial distances could be eliminated, a more compact and less complicated CDMA base station could be built. Further, if in doing so, interference reduction and gain improvement could also be achieved, the receiver operation could simultaneously be improved.

In sum, the need exists for improved apparatus, systems and methods for receiving CDMA signals in a wireless communications system. Such apparatus, systems and methods should reduce fading caused by interference and improve receiver gain. Further, the ability to build a more compact Rake receiver based CDMA receiver system would also be of substantial advantage.

SUMMARY OF THE INVENTION

The principles of the present invention allow for multiple antenna beams to be used to feed a smaller number of receiver input ports. Such multiple beams may be provided by either a single multibeam antenna or a plurality of co-located discreet antennas. By using multiple, narrow, beams to focus on selected mobile units, interference can be substantially reduced and antenna gain substantially increased. Receiving systems embodying the principles of the present invention can be advantageously applied to wireless communication systems, such as cellular telephone systems, although such principles are not necessarily limited to these applications.

According to a first embodiment of the present invention, a receiving system is provided which includes at least one antenna providing a plurality of antenna beams. A first processing branch is included for processing a first plurality of signals appearing within first selected ones of the antenna beams. The first processing branch includes a plurality of delay paths, each of these delay paths receiving one of the first plurality of signals from a corresponding one of the first antenna beams and applying a pre-selected amount of delay thereto, the pre-selected amount of delay being proportionate to the corresponding one of the beams. The first processing branch also includes a combiner for combining the first plurality of signals after output from the plurality of delay paths of the first processing branch. A second processing branch is provided for processing a second plurality of signals appearing within second selected ones of the antenna beams. The second processing branch includes a plurality of delay paths, each of the delay paths receiving one of the second plurality of signals from a corresponding one of the second antenna beams and applying a pre-selected amount of delay thereto, the pre-selected of delay being proportionate to the corresponding one of the beams. A combiner is also provided for combining the second plurality of signals after output from the delay paths of the second processing branch. Finally, the receiving system includes a receiver having a first port coupled to an output of the first processing branch and a second port coupled to the second processing branch.

According to another embodiment of the present invention, a receiving system is provided which includes a CDMA receiver and a multibeam antenna providing a plurality of reception beams. A first plurality of delay paths couple the multibeam antenna with a sector input port of the receiver, each of the first plurality of delay paths introducing a predetermined amount of delay to a signal received from a corresponding one of a first set of the plurality of beams. A second plurality of delay paths couple the multibeam antenna with a diversity input port of the receiver, each of the second plurality of delay paths introducing a predetermined amount of delay to a signal received from a corresponding one of a second set of the plurality of beams.

According to a further embodiment of the present invention, a receiving system is provided which includes a plurality of antennas. First mixing circuitry is coupled to an output of selected ones of the antennas for mixing down signals received by those selected antennas. A plurality of delay devices are coupled to the mixing circuitry for delaying a mixed down signal received by a corresponding one of the selected antennas by a predetermined amount. Second mixing circuitry is coupled to the delay devices for up mixing delayed signals output from the delay devices. Signal combining circuitry is provided for combining the delayed signals output from the second mixing circuitry.

According to another embodiment of the present invention, a wireless communications receiving system is provided which includes a plurality of antennas and a CDMA receiver, the receiver having a number of inputs less than or equal to the number of antennas. A matrix switch is provided for coupling outputs of selected ones of the antennas to the inputs of the receiver.

The principles of the present invention provide substantial advantages over the prior art. In particular, multiple antennas may be connected to a receiver which has a number of input ports less than the number of antennas desired. Further, according to the present invention, narrow beam antennas may be used with a CDMA receiver to substantially reduce interference and provide increased antenna gain. Further, antennas constructed in accordance with the principles of the present invention do not require substantial, or even precise, spacing between antennas, as is required in present antenna systems to ensure that incoming signals are uncorrelated.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which:

FIG. 5 is a functional block diagram of an alternate receiving system according to the present invention;

FIG. 6 is a functional block diagram of another alternate receiving system according to the present invention; and FIG. 7 is a functional block diagram of a prior art CDMA receiving system.

DETAILED DESCRIPTION OF THE INVENTION

The principles of the present invention and their advantages are best understood by referring to the illustrated embodiment depicted in FIGS. 1–7 of the drawings, in which like numbers designate like parts.

FIG. 7 is a general block diagram of a CDMA base station configuration 700 typically used in presently available wireless communications systems, such as cellular telephone systems. In the conventional system of FIG. 7 the CDMA receiver 701 receives signals from three "faces," each of which covers a 120 degree sectors. Each sector is concurrently covered by two antennas: a sector antenna 702 with a 120 degree field of coverage and diversity antenna 703, also with a field of coverage of 120 degrees. The sector antenna 702 and diversity antenna 703 for each face is physically spaced by approximately 10–15 times the wavelength of the received signal. In current cellular telephone CDMA systems, this equates to approximately ten feet. While further separation would be desirable to insure that the incoming signals are uncorrelated, increased separation is typically impractical due to space limitations.

Figure 1A:
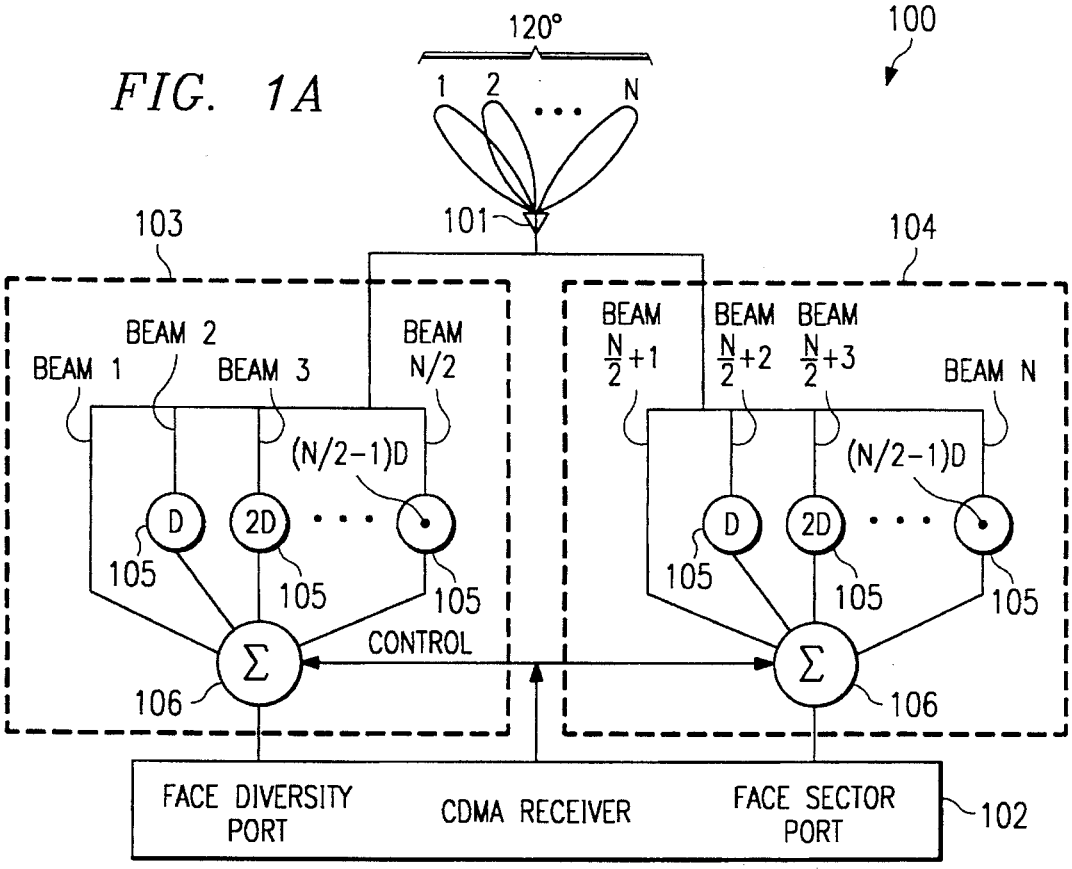
FIG. 1A and 1B are functional block diagrams of exemplary receiving systems according to the principles of the present invention.

FIG. 1A is a block diagram of one face of a CDMA receiving system 100 according to one embodiment of the principles of the present invention. An N-beam multibeam antenna 101 feeds both the face sector input port and the face diversity input port of a CDMA receiver 102 through a pair of parallel processing branches 103 and 104. In a three sector configuration, the N beams of antenna 101 together provide a coverage area of 120 degrees (one sector). Multibeam antenna 101 may also be an omni-directional (i.e., multiple beams, for example twelve, covering 360 degrees) for use in a system configuration where CDMA receiver 102 includes only a sector port and a diversity port. In the preferred embodiment, antenna 101 comprises a series of dipoles spaced in front of a ground plane in conjunction with a Butler matrix. In alternate embodiments, any of a number of multiple beam antennas known in the art can be used.

Figure 1B:
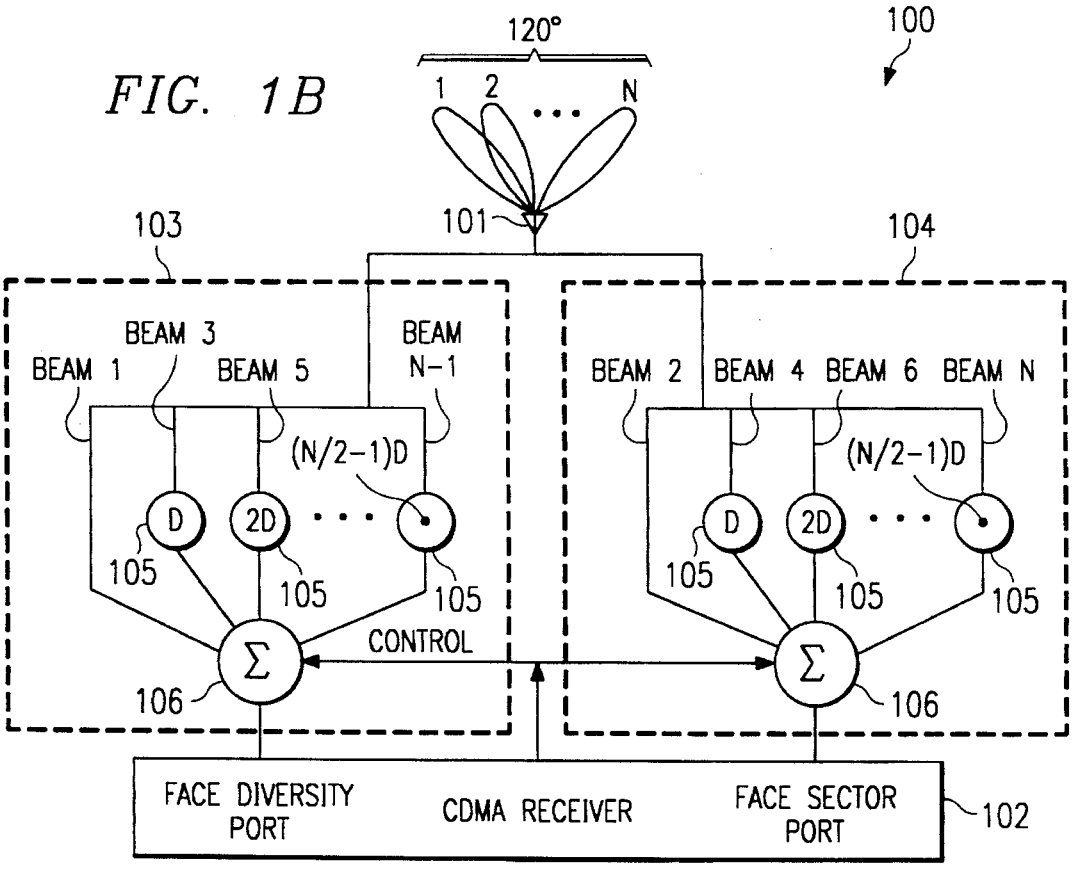
Figure 2:
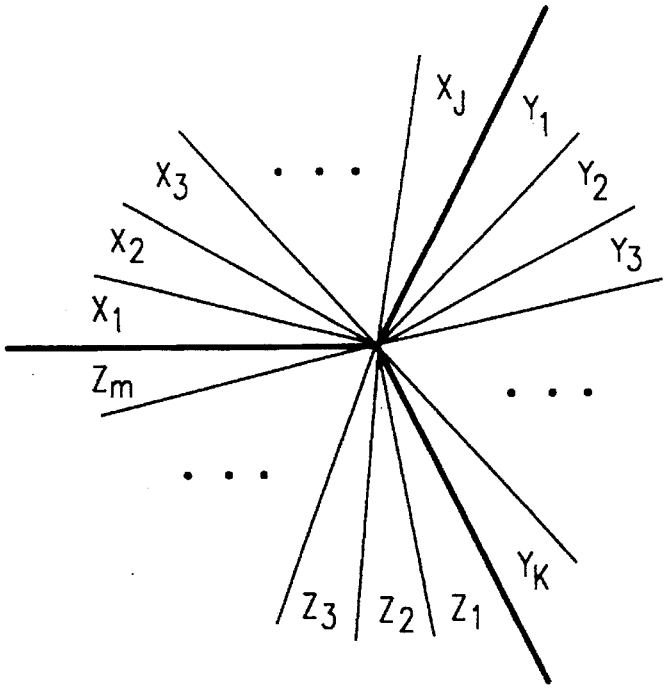
FIG. 2 is a beam diagram depicting one possible distribution of antenna beams according to the principles of the present invention.

The coverage from a three face configuration is shown for illustrative purposes in FIG. 2. Three multibeam antennas systems 100 are employed to cover 360 degrees with one antenna providing beams X1–Xj to the first face, a second providing beams Y1–Yk to a second face and a third antenna providing beams Z1–Zm to a third face. The variables j, k, and m are each equal to the variable N in FIG. 1.

In the embodiment of FIG. 1A, the first half of the N beams from antenna 101 (i.e beams 1 to N/2 consecutively) feed the diversity port through branch 103 and the second half of the beams (i.e. beams N/2+1 to N consecutively) feed the sector port through branch 104. In alternate embodiments, beams 1 to N/2 can feed the sector port through branch 104 and beams N/2+1 to N feed the diversity port through branch 103 without affecting system operation. A second embodiment of system 100 is shown in FIG. 1B, where the odd numbered beams are processed through branch 103 and the even number beams are processed through branch 104. A number of other splits of the beams from antenna 101 through branches 103 and 104 are possible according to the principles of the present invention.

Each branch 103 and 104 includes a plurality of signal delay devices 105 and a combiner 106. The signals received by the respective beams are subjected to varying amounts of delay such that they are time-wise spread when they reach the corresponding ports of receiver 102. In the FIG. 1A embodiment, the beam with the lowest indicia (number) for each branch 103 and 104 (i.e beam 1 and beam N/2 respectively) is passed to combiner 106 without the introduction of a delay. The beam with the second lowest indicia (i.e beam 2 and N/2+1) receives a delay of one delay unit D, the next beams a delay of two delay units 2D, and so on. Ultimately, beams N/2 and N are delayed by (N/2–1)D units of delay. In other words, the delay for the signals output appearing within a given antenna beam having a beam number B is (B–1)D.

The unit of delay D can be approximated from the formula:

$$DN/2<64 \text{ usec}$$

where D is the unit of delay and N is the number of antenna beams, as discussed above. This constraint arises because in current CDMA receiving systems an adjacent sector (face) could be receiving and processing signals with a 64 μsec delay with respect to the current phase. In other words, the signals received at the current sector are not delayed more than 64 μsec such that they do not overlap signals from the adjacent face reaching the ports of receiver 102.

Experimental evidence has shown that most multipath reflections resulting from a transmission arrive at an omnidirectional antenna generally within 3–4 μsec from the arrival of the first signal from the transmission (typically the direct signal). This corresponds to an approximate difference in path length of 3000 to 4000 feet. Further, most reflections off distant mirrors are substantially attenuated. For example, if a mobile is removed from the base station by 4 μsecs, a reflection off a mirror 2 μsecs further distant will return a signal to that base station 4 usecs after the first signal arrival, but attenuated by 6 dB. In sum, for a given transmission, very little energy is received from a given transmission more than 5 μsecs after arrival of the first received signal.

The outputs of combiner 106 are fed to the sector and diversity ports of CDMA receiver 102. In the preferred embodiment, CDMA receiver 102 comprises a four finger Rake receiver whose front end delays substantially match the delays through branches 103 and 104. In the case of a four finger Rake receiver, the four strongest signals from all the faces are preferably taken for processing after the delays of branches 103 and 104. Alternatively, the four strongest signals from a single selected face may be taken at a time.

In the preferred embodiment, delays 105 are implemented with surface acoustic wave (SAW) devices (e.g. SAW filters). Such devices achieve delay by converting electrical energy into acoustic waves, usually in a quartz crystal, and then recoupling the acoustic waves back into electrical energy at their output. Advantageously, such devices are compact and eliminate the unwieldy cables used to introduce delays in the prior art systems.

Also, in the preferred embodiment, combiners 106 are adaptive summing devices which perform signal combining as a function of signal power. The stronger the signal, the more weight that signal is given during the combining. For optimal performance, combiners 106 add signals according to the square of the signal power in each path (maximal ratio combining). If a path is carrying no signal, the path is attenuated strongly producing a weight of near zero. Preferably, CDMA receiver 102 includes a searcher or scan receiver which controls the adaptive summing devices and sets the weights. In the alternate embodiments, where no searcher or scan receiver is provided, the weights can be set as equal.

Figure 3:
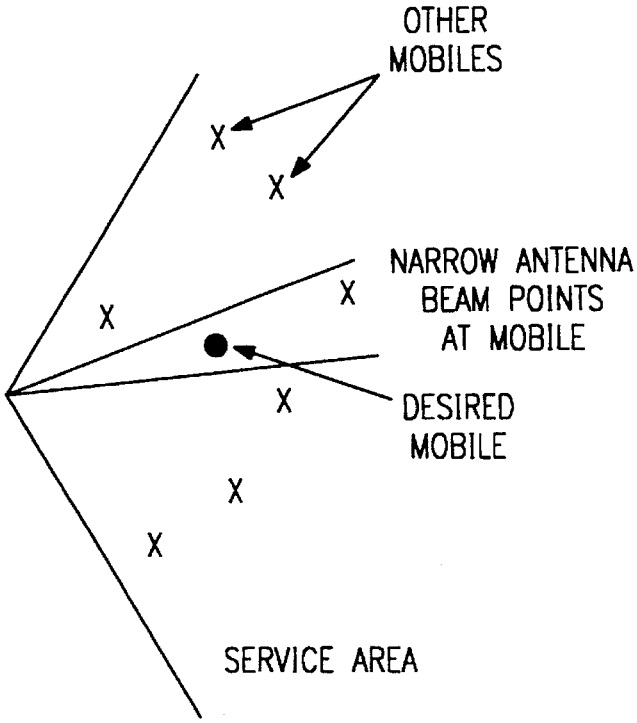
FIG. 3 is a diagrammatic illustration of the operation of the system of FIGS. 1A and 1B.

By employing narrow multiple beams instead of the wide single beams used in present systems, substantial performance improvement is achieved. First, since narrow beams are more highly directional, focus on the signal from a desired mobile in a wireless communications system can be made to the exclusion of signals from other mobiles operating in the same sector. This focusing is preferably done on the basis of the mobile user's assigned identification code. This feature reduces the interference from undesired mobiles. An example is shown in FIG. 3 where eight mobile units are operating in the sector and the with the CDMA attempting to receive a single mobile (based on the users identification code). Six of the other mobiles are excluded as being outside the beam coverage of the narrow beam directed at the desired mobile; noise from direct signals is thereby reduced from 7 noise units to 1.

With the present invention, substantial spacing is not required to maintain signal separation. Each beam (from either a multiple-beam antenna or a plurality of discrete antennas) has a different angular coverage (i.e. each beam has a different view). Thus, angular rather than spacial diversity is achieved. Since each beam is viewing a different phase front, the signals received by such beams are uncorrelated and can be accordingly processed by the Rake receiver.

Further, narrower beams generally provided higher gain. Higher gain allows the mobiles to transmit with less power or operate over longer paths (separations from the base station) with the same power. Finally, the multibeam approach is advantageously compact.

It should be noted that the antenna beams may be polarized to further improve performance. Mobile users very rarely hold the mobile unit antenna vertically such that the polarization of the mobile unit antenna matches that of the base station. As a result, the component in the cross-polarization direction is lost at the base station. Antenna 101 may therefore be constructed from two polarized multibeam antennas whose patterns overlap such that the cross-over from one pattern is at the peak of the other. The polarization of the second antenna is preferably orthogonal (or at least offset) from the polarization of the first antenna. For example, the first and second antennas may be right hand and left hand circularly polarized, respectively.

Figure 4:
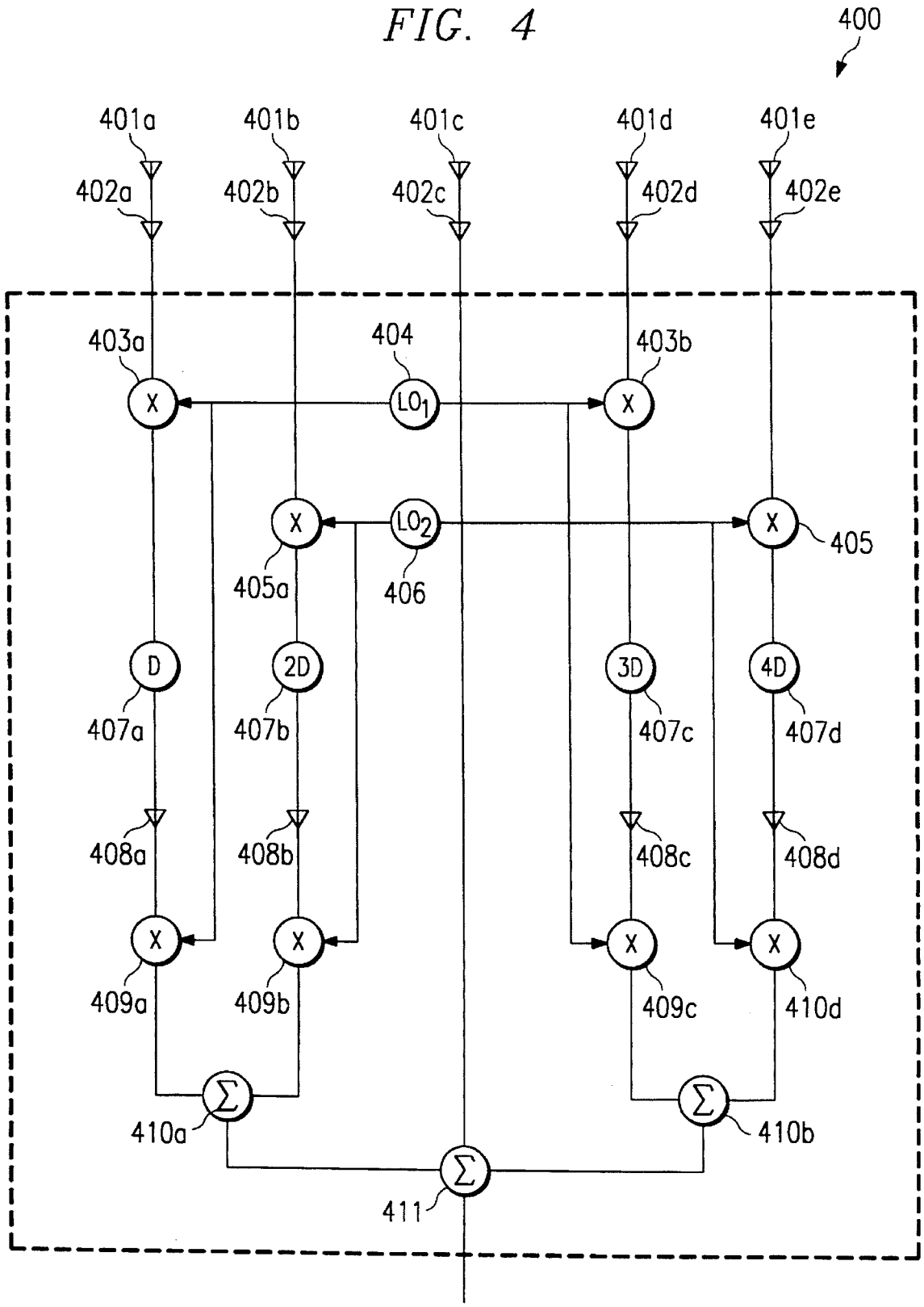
FIG. 4 is a functional block diagram of an alternate antenna system for use in a receiving system embodying the present invention.

The principles of the present invention are not limited to the use of multibeam antennas and may be equally applied to systems using multiple discrete antennas. A discrete antenna system 400 according to the principles of the present invention is depicted in FIG. 4. In a conventional CDMA receiving system, two antenna systems 400 are employed per face, one to feed the sector port and the other to feed the diversity port.

Antenna system 400 includes N-number of antennas 401. Five antennas 401*a*–401*e* are depicted in FIG. 1, although in alternate embodiments the number N will vary. The coverage of antennas 401 will also vary from application to application. For example, for a three sector receiving system, the N-number of antennas will provide 120 degrees of coverage for the corresponding face and in an omni-directional system provide 360 degrees of coverage.

The signals output from each of antennas 401 are passed through a low noise amplifier 402 to improve the system noise figure. Next, the signals from each antenna 401, with the exception of the signals from antenna 401*c*, are mixed down by mixers 403. In the illustrated embodiment, the signals from antennas 401*a* and 401*b* are mixed with a signal from local oscillator (LO1) 404 with mixers 403*a* and 403*b* and the signals from antennas 401*b* and 401*e* are mixed from a second local oscillator (LO2) 406 with mixers 405*a* and 405*b*. Local oscillators 404 and 406 preferably output a local oscillator signal at the same frequency. In cellular telephone and PCS systems where the incoming RF signals are at a frequency of 800 MHz or 1.8 GHz, the local oscillator signal is selected to provide an IF signal of 70 or 140 MHz. Two local oscillators 404 and 406 are provided in the illustrated embodiment such that if one fails, some system receiving capability is maintained. In alternate embodiments, only a single local oscillator may be used.

After mixing, the IF signals are passed through delays 407*a*–407*d*. The delays are selected according to the principles of the present invention discussed above. The output of each of the delays 407 is then passed through a corresponding amplifier 408. The gain of amplifiers 408 is set proportional to the signal energy on that path. Next, the IF signals are up mixed using local oscillators 404 and 406. By mixing back to the original RF frequency, antenna system 400 appears transparent to the CDMA receiver with regards to frequency.

The delayed outputs from antennas 401*a* and 401*b* are combined with combiner 410*a* and the delayed outputs of antennas 401*d* and 401*e* are combined with combiner 410*b*. The output of combiners 410*a* and 410*b* and the direct output of antenna 410*c* are then combined with combiner 411, whose output is fed to the respective sector or diversity port of the associated receiver.

It should be noted that the center antenna 401*c* in this embodiment may be used in different ways depending on the application. For example, it could be switched to the receiver as a path with a delay of zero and have a field of view similar to the other antennas 401. In the alternative, antenna 401*c* may encompass the entire field of view of antennas 401 and output signals at a lower power level. For example, if antennas 401*a*, 401*b*, 401*d* and 401*e* together cover a 120° sector, antenna 401*c* similarly covers 120 degrees. In this case, antenna 401*c* normally would not be selected but used only if the delayed paths failed; the single antenna 401*c* would still provide some reduced performance.

Antenna system 400 not only allows for discrete narrow beam antennas to be used in a receiving system, but also allow for the use of multiple antennas in CDMA receiving systems in which the receiver has a limited number of input ports. For example, some CDMA receivers are designed to operate with omni-directional antennas and thus only have one sector port and one diversity port. According to the present invention, multiple narrow beam antennas can be coupled to those ports. The narrow beam approach of system 400 advantageously provides higher gain, reduced multipath and reduced outside interference, as well as increasing the number of antennas which may be used.

An alternative embodiment of the principles of the present invention is depicted in FIG. 5. Receiving system 500 uses multiple discrete antennas 501 to direct narrow beams to the mobile units. The advantages of narrow beams have been discussed above. In the embodiment of FIG. 5, a matrix switch 502 switches a selected number of antennas to CDMA receiver 503. The CDMA transmitter 504 is also shown for reference. Assume for discussion purposes that the three face system of FIG. 2 is being implemented.

If j, k, and m (in this case the number of antennas per sector) are less than or equal to R, the number of lines coupling matrix switch 502 and receiver 503, either the x, y, or z antenna group is switched to CDMA receiver 503. R is typically 6 for conventional CDMA receivers. The determination of which group is switched is determined by the sector receiver 502 is using.

Assuming for discussion that R=6, if j=k=4, then the output from two selected antennas per sector are coupled to receiver 503. Preferably, the two selected antennas are those disposed immediately adjacent the next sector. Receiver 503 automatically selects the three antennas providing the strongest output. Many other combinations are possible.

Finally, assuming j, k, or m is greater than R, then the apparatus and methods discussed above with regards to FIGS. 1–3 are preferably employed.

FIG. 6 depicts a further system for receiving CDMA signals. As with the apparatus, systems and methods discussed above, the system of FIG. 6 advantageously allows for the use of narrow beam antennas and/or for the use of more antennas than inputs are available at the receiver. In this system, the antennas X1–Zm are coupled to a matrix switch 601. Matrix switch 601, under the control of a scan receiver 602, selectively couples S number of signals to a CDMA receiver 603. Scan receiver 602 may or may not be integral with CDMA receiver 603.

Specifically, during operation, scan receiver 602 searches across all the antennas for the S number of strongest signals bearing the identification code of the desired mobile. Once these signals have been identified, matrix switch 601, under control of scan receiver 602, couples those antennas outputting the S strongest signals with CDMA receiver 603.

Although the present invention and its advantages have been described in detail, it should be understood that various changes, substitutions and alterations can be made herein without departing from the spirit and scope of the invention as defined by the appended claims.

Although the present invention and its advantages have been described in detail, it should be understood that various changes, substitutions and alterations can be made herein without departing from the spirit and scope of the invention as defined by the appended claims.

What is claimed is:

1. A receiving system comprising:

at least one antenna providing a plurality of antenna beams, said plurality of beams disposed for providing angular diversity between corresponding received signals;

a first processing branch for processing a first plurality of signals appearing within a first selected plurality of said antenna beams, said first processing branch comprising:

a plurality of delay paths, each said delay path receiving a one of said first plurality of signals from a corresponding one of said first selected plurality of antenna beams and introducing a preselected amount of delay thereto, said preselected amount of delay proportionate to said corresponding one of said beams: and a combiner for combining said first plurality of signals after output from said plurality of delay paths;

a second processing branch for processing a second plurality of signals appearing within a second selected plurality of said antenna beams, said second processing branch comprising:

a plurality of delay paths, each said delay path receiving a one of said second plurality of signals from a corresponding one of said second plurality of antenna beams and introducing a preselected amount of delay thereto, said preselected amount of delay proportionate to said corresponding one of said beams: and a combiner for combining said second plurality of signals after output from said plurality of delay paths; and a receiver having a first port coupled to an output of said first processing branch and a second port coupled to said second processing branch.

2. The receiving system of claim 1 wherein said at least one antenna provides N number of antenna beams and said first and second processing branch each includes N/2 delay paths for processing signals from N/2 ones of said antenna beams.

3. The receiving system of claim 2 wherein each of said first plurality of antenna beams is associated with a beam number B and wherein said delay paths of said first processing branch processes signals from beams each having a beam number B in the range of 1 to N/2.

4. The receiving system of claim 2 wherein each of said first plurality of antenna beams is associated with a beam number B and wherein said delay paths of said first processing branch process signals from beams each having an odd beam number B.

5. The receiving system of claim 2 wherein each of said first plurality of antenna beams is associated with a beam number B and said delay provided by each of said delay paths of said first branch is substantially equal to (B−1)D, wherein D is a preselected unit of delay.

6. The receiving system of claim 2 wherein each of said second plurality of antenna beams is associated with a beam number B and wherein said delay paths of said first processing branch processes signals from beams each having a beam number B in the range of N/2+1 to N.

7. The receiving system of claim 2 wherein each of said second plurality of antenna beams is associated with a beam number B and wherein said delay paths of said second processing branch process signals from beams each having an even beam number B.

8. The receiving system of claim 2 wherein each of said second plurality of antenna beams is associated with a beam number B and said delay provided by each of said delay paths of said second branch is substantially equal to (B−1)D, wherein D is a preselected unit of delay.

9. The receiving system of claim 1 wherein said at least one antenna comprises a multibeam antenna.

10. The receiving system of claim 1 wherein said at least one antenna comprises a plurality of discrete antennas each providing a corresponding one of said beams.

11. The receiving system of claim 1, wherein first ones of said plurality of beams have a first polarization and second ones of said plurality of beams have a second polarization different from said first polarization.

12. The receiving system of claim 1 wherein each of said delay paths includes a surface acoustic wave device for introducing said preselected amount of delay.

13. A receiving system:

a CDMA receiver;

a multibeam antenna providing a plurality of reception beams, each said beam having a separate angular coverage;

a first plurality of delay paths coupling said multibeam antenna with a sector input port of said receiver, each of said first plurality of delay paths introducing a predetermined amount of delay to a signal received from a corresponding one of a first set of said plurality of beams; and a second plurality of delay paths coupling said multibeam antenna with a diversity input port of said receiver, each of said second plurality of delay paths introducing a predetermined amount of delay to a signal received from a corresponding one of a second set of said plurality of beams.

14. The receiving system of claim 13 wherein a first group of said beams have a first polarization and a second group of said beams have a second polarization different from said first polarization.

15. The receiving system of claim 13 wherein said first group of beams overlaps coverage of said second group of beams and wherein a cross-over of a pair of said front group of beams coincides with a peak of a beam of said second group.

16. The receiving system of claim 13 wherein a Bth one of said first plurality of delay paths introduces a delay of (B−1)D between said antenna and said sector port of said receiver, wherein D is a unit of delay and B is an integer.

17. The receiving system of claim 16 wherein B is an integer between 1 and N/2.

18. The receiving system of claim 16 wherein B is an odd integer between 1 and N.

19. The receiving system of claim 13 wherein a Bth one of said second plurality of delay paths introduces a delay of (B−1)D between said antenna and said diversity input port, wherein D is a unit of delay and B is an integer.

20. The receiving system of claim 19 wherein B is an integer between N/2+1 and N.

21. The receiving system of claim 19 wherein B is an even integer between 1 and N.

22. The receiving system of claim 13 wherein said second plurality of delay paths are coupled to said diversity port through a signal combiner.

23. The receiving system of claim 13 wherein said first plurality of delay paths are coupled to said sector port through a signal combiner.

24. A receiving system comprising:

a plurality of antennas, said antennas disposed to provide angular diversity between signals received thereon;

first mixing circuitry coupled to an output of selected ones of said antennas for mixing down signals received by said selected ones of said antennas;

a plurality of delay devices coupled to said mixing circuitry for delaying a mixed down signal received by a corresponding one of said selected ones of said antennas by a predetermined amount;

second mixing circuitry coupled to said delay devices for up mixing delayed signals output from said delay devices;

first signal combining circuitry for combining delayed signals output from said second mixing circuitry; and second signal combining circuitry for combining delayed combined signals output from said first signal combining circuitry with an undelayed signal received from at least one of said plurality of antennas.

25. The system of claim 24 wherein said first and second mixing circuitry is driven by substantially the same local oscillator frequency.

26. The system of claim 24 and further comprising a CDMA receiver having a sector input coupled to an output of said second signal combining circuitry.

27. A method of receiving signals from a plurality of mobile communicating devices and for presenting received ones of said signals to the sector and diversity inputs of a signal receiver, said method including the steps of:

angularly spacing a plurality of antenna beams across a sector in which signals are expected to be received, each antenna beam having a narrow beam width;

dividing the signals received on all of the beams in half so that half of the received signals are processed by a first set of delays and the remaining half of the signals are processed by a second set of delays;

delaying each of the signals in the respective sets by a different delay time; and summing all of the signals processed by each delay set together to form two signal sets, one set for presentation to the sector input and one set for presentation to the diversity input of the signal receiver.

28. The method of claim 27 wherein said delaying step includes the passing of the signals through a surface acoustic wave filter.

29. The method of claim 28 wherein said delay is characterized as $DN/2<64$ μsec, where D is the unit of delay and N is the number of antenna beams.

30. The method set forth in claim 27 further including the step of selecting a subset of signals from all of the possible signals prior to said dividing step.

31. The method set forth in claim 30 wherein said selecting step includes the step of determining which ones of the signals meet a given criteria.

32. An antenna system for receiving signals from a plurality of mobile communicating devices and for presenting received ones of said signals to the sector and diversity inputs of a signal receiver, said system comprising:

a plurality of antenna beams spaced angularly across a sector in which signals are expected to be received, each antenna beam having a narrow beam width;

means for dividing the signals received from all of the beams in half so that half of the received signals are processed by a first set of delays and the remaining half of the signals are processed by a second set of delays;

means for delaying each of the signals in the respective sets by a different preset delay time; and means for summing all of the signals processed by each delay set together to form two signal sets, one set for presentation to the sector input and one set for presentation to the diversity input of the signal receiver.

33. The system set forth in claim 32 wherein said delaying means includes a surface acoustic filter.

34. The system set forth in claim 32 wherein at least one of said first or second plurality of delay paths includes a surface acoustic wave device.

* * * * *